United States Patent [19]

Gomez

[11] Patent Number: 4,943,349

[45] Date of Patent: Jul. 24, 1990

[54] PROCESS FOR PREPARING A SHEET MATERIAL WITH IMPROVED ON-MACHINE RETENTION

[75] Inventor: Daniel Gomez, Mimizan, France

[73] Assignee: Papeteries de Gascogne, Mimizan, France

[21] Appl. No.: 18,754

[22] Filed: Feb. 20, 1987

Related U.S. Application Data

[63] Continuation of Ser. No. 594,440, Mar. 30, 1984, abandoned, which is a continuation of Ser. No. 312,946, Oct. 20, 1981, abandoned.

[30] Foreign Application Priority Data

Oct. 21, 1980 [FR] France ..... 80 22501

[51] Int. Cl.[5] ..... D21H 3/02

[52] U.S. Cl. ..... 162/158; 162/164.3; 162/164.6; 162/168.1; 162/168.2; 162/168.3; 162/169; 162/174; 162/175; 162/177; 162/181.1; 162/181.2; 162/181.8; 162/183

[58] Field of Search ..... 162/181.1, 181.2, 181.8, 162/175, 168.1, 183, 135, 169, 168.2, 168.3, 164.6, 164.3, 177, 174, 178, 158; 594/440

[56] References Cited

U.S. PATENT DOCUMENTS 4,181,567 1/1980 Riddell et al. ..... 162/183
4,210,490 7/1980 Taylor ..... 162/183

*Primary Examiner*—Peter Chin
*Attorney, Agent, or Firm*—Francis J. Bouda

[57] ABSTRACT

Process for using papermaking techniques for preparing a sheet material with improved on-machine retention, sheet material thus obtained and its application, notably in the field of printing and writing, packaging and coverings.

The invention relates to a process for using papermaking techniques to make a sheet material.

This material copmrises, in addition to the fibres, an organic binder, a non-binding mineral filler and a flocculant, as well as various conventional additives, this process being characterized by the fact that the mineral filler and the binder are flocculated beforehand before being incorporated into the fibre suspension.

The material thus prepared has enhanced mineral filler retention and physical properties and can be used as printing and writing medium, covering medium, packaging medium or for obtaining complexes for industrial or foodstuffs use.

11 Claims, No Drawings

PROCESS FOR PREPARING A SHEET MATERIAL WITH IMPROVED ON-MACHINE RETENTION

This application is a continuation of application Ser. No. 594,440, filed Mar. 30, 1984, now abandoned, which is a continuation application of Ser. No. 312,946, filed Oct. 20, 1981, now abandoned.

The present invention relates to a process for using papermaking techniques to prepare a sheet material comprising, in addition to fibres, an organic binder, a non-binding mineral filler and a flocculant, along with various conventional paper additives, designed to improve the retention of the mineral filler in the sheet, sheet formation and the sheet's physical properties.

The invention also involves a process enabling pollution to be reduced, on the one hand by cutting down on the amount of mineral matter which passes through the papermaking machine screen and also by reuse of coating baths in the paper mass.

The ever increasing cost of the fibres used in producing sheet materials have led the papermaking industry to replace fibres by mineral fillers which can be used in larger or smaller quantities.

Papermaking processes are known for the manufacture of sheet materials comprising fibres, non-binding mineral fillers, binders and flocculants. These processes call on methods of in situ precipitation in the suspension containing the fibres, mineral fillers and binders by means of flocculating agents which may be introduced either before or after the binder, as in the published French patent applications Nos. 2 410 084 and 2 429 293, or in the published European patent application No. 0 006 390, or after the binder, as is common in papermaking and described, for example, in the published French patent application No. 2 416 291.

In this type of process the mineral fillers and organic binders common in the paper industry destined to be mixed into the paper mass are generally added to the fibres at successive stages in pulp preparation. When the mineral fillers and the organic binders are used for surface treatments like coating on or off the machine, the mineral particles are dispersed beforehand in the aqueous phase with a surface-active agent, preferably anionic, before being mixed with one or more types of organic binder. The coating bath, which is characterized by very good stability, an essential property for good coating uniformity, is never injected into the mass.

On the contrary the present invention relates to a process for using papermaking techniques to prepare a sheet material in which the mineral filler and the organic binder, which have been previously flocculated, are incorporated simultaneously into the fibre suspension, with agitation.

The process of the invention thus permits improved flocculation control and good uniformity of the floc particle size, which favours formation, appearance and uniformity of surface and sheet inertia.

The process according to the invention also makes it possible to improve the fibre-filler-binder bonds, which leads to improved sheet physical properties being obtained, notably with respect to internal cohesion, bursting strength and sheet resistance which become adequate for very fast machines.

By means of the process according to the invention the retention of the mineral fillers in the sheet is considerably improved.

Furthermore, the process according to the invention permits recycling of the coating baths in the paper mass, which cuts down on pollution.

An object of the present invention is therefore a process for using papermaking techniques to make a sheet material containing fibres, a non-binding mineral filler, an organic binder and a flocculating agent, according to which the mineral filler and the organic binder are previously flocculated before being incorporated into the fibre suspension.

Another object of the present invention is also the sheet material thus obtained and its application both as a printing and writing medium, covering medium or packaging medium or for obtaining complexes for industrial or food applications.

The process according to the invention consists in preparing an aqueous dispersion of mineral filler particles coated with binder, which is made to continuously undergo ionic destabilization by means of a cationic flocculant before being introduced into the fibre suspension.

According to a preferred embodiment of the process of the invention, before mixing the flocculated filler and binder into the fibrous suspension, the anionic strength of the latter is increased by adding, with agitation, an anionic type retention agent.

The process according to the invention makes it possible to prepare, with conventional paper industry manufacturing, surfacing or coating and finishing means, a sheet material possessing advantageous properties for printing and writing, impregnation, coating, packaging and obtaining complexes with various materials, designed notably for the food industry.

All types of fibre are suitable for manufacturing the sheet material according to the invention, but preferably high-quality cellulose fibres are used, i e. those from softwood and/or hardwood pulp, combined, if necessary, with recycled fibres from waste paper and rags, for example. For certain special applications it is also possible to combine cellulose fibres with synthetic high-polymer fibres like polyamide or polyester fibres or with mineral fibres like glass, ceramic, calcium sulphate or carbon fibres, or again with cellulose regeneration fibres, or with mixtures thereof.

For a printing or writing application, or for wall coverings, combinations will be chosen of, for example, softwood pulps treated with caustic soda or bisulphite, semi-bleached or bleached.

For packaging or for obtaining complexes for foodstuffs, bleached or unbleached caustic soda-treated softwood pulps will be preferred The non-binding mineral fillers capable of being used in the process according to the invention are all the normal mineral fillers used in papermaking and in the paint industry like, for example, talc, kaolin, natural or precipitated calcium carbonate or calcium carbonate from operations of recovery of the black liquors extracted from the digesting of kraft papers and more especially after the causticizing operation, magnesium carbonate, alumina hydrates, calcium sulphate, colloidal silica, barium sulphate, titanium dioxide, satin white (hydrated calcium sulphoaluminate), magnesium hydroxide or mixtures thereof.

For conventional applications in printing and writing, packaging or for media for coating in aqueous phase, by means of solvents or for plastisols, talc or kaolin in acid sizing (usual pH 4.5–6), or calcium carbonate, natural or precipitated or from regeneration of kraft pulp cooking liquors in neutral or basic sizing (pH 6.5) will preferably be used, for economic reasons.

The amount of mineral filler to be introduced compared with the amount of fibres may vary widely according to the required applications.

For example, in printing and writing papers, the amount of filler remaining in the sheet may range from 5 to 40% by weight and notably from 10 to 30% by weight compared with the paper weight. For various coverings intended for the building industry the filler content may exceed 50% by weight of the paper. For packaging applications of small, medium, large capacity bag type or for kraft envelopes or address band media, for example, the amount of remaining fillers may range between 2 and 15% by weight compared with the paper weight.

The organic binder capable of being used in the process according to the invention is any kind of organic binder, natural or synthetic, normally used in papermaking in the mass or in a coating bath. It binds the material constituents together and enables the physical properties of the sheet material to be improved. For binders suited for use in the process of the invention the following may be quoted: native starches or starches modified by chemical, enzymatic or thermal means, dextrines, polyvinyl alcohols, casein, animal glue, vegetable proteins, cellulose esters like carboxymethylcellulose, alginates, dispersions of synthetic polymers like carboxylated or uncarboxylatei styrene-butadiene latexes, acrylic latexes, styrene acrylics, vinyl acetates, neoprene latexes, acrylonitrile latexes, vinyl chloride latexes.

The amount of binder depends on the final use envisaged for the sheet material, but it may vary between 1 and 40 parts by weight and preferably between 1 and 25 parts by weight, compared with 100 parts by weight of fibre and fillers.

According to another characteristic of the process of the invention, a mineral or organic agent for destabilization of the bath containing the mineral filler and the organic binder, also called a flocculant, may be used This product can be of the retention agent or cationic flocculant type usual in papermaking. The flocculant has the role of precipitating out the mineral filler and the organic binder before mixing with the fibres by ionic destabilization. This flocculating agent also enables the sheet's wet strength to be improved.

Amongst the cationic flocculants which are suitable for the process of the invention one can mention aqueous solutions of polyethylenimine, polyamide-amine, cross-linked polyalkylamine, modified polyacrylamides, polyaluminium chloride, aqueous solutions of quaternary ammonium compounds like ammonium chlorohydroxypropyltrimethyl and the cationic starches.

The flocculating agent is continuously mixed into the aqueous suspension containing the mineral filler and the organic binder, in amounts generally lying between 0.006 and 5 parts by weight and preferably between 0.01 and 2 parts by weight for 100 parts of mineral filler and binder. The exact quantity to be used depends on four factors:

the concentration of the aqueous suspension of filler and binder;

the flocculant/filler/binder contact time which depends on the configuration of the paper machine's head circuits;

agitation;

the cationic power of the flocculant.

However, as a general rule, this amount is regulated so that total flocculation is achieved in a maximum of one minute.

According to a preferred embodiment of the process of the invention, an anionic retention agent is added to the fibre suspension before the flocculant/binder/filler particles are incorporated, in order to increase its anionic power. As anionic retention agent it is possible to use, for example, a high molecular weight ($5\times10^6$ to $10^7$) modified polyacrylamide or a sodium polyacrylate, for example.

The anionic retention agent combined with the flocculated binder on the filler plays the part of strengthening the fibre-binder bonds in order to get improved retention on the screen and also an increase in the internal cohesion of the sheet.

The amount of anionic retention agent depends on the anionicity of the pulp used, which depends on the manufacturing process (kraft or bisulphite pulp), but also on the conditions of washing of the pulp before use. A kraft pulp from an integrated mill possesses a much more marked anionic character than a pulp that has been dried and stored before being sent to the paper machine. It will be advantageous to use 0.005 to 1 part by weight of anionic retention agent for 100 parts by weight of fibres.

In addition to the fibres, the mineral filler, the organic binder and the anionic and cationic flocculants, various conventional paper industry additives can be used in the process for making a sheet material according to the invention, like:

A sizing agent normally used in papermaking to reduce the sheet's sensitivity to water, like modified cellophanes, paraffin emulsions, alkylketene dimers. .

A pH control agent, for example aluminium sulphate or sulphuric acid designed to adjust the pH to 4.5–6 for sizing in an acid medium.

An anti-foaming agent.

An optical blueing agent.

A dyeing or shading agent.

=An agent providing strength in the moist state, like urea-formol, melamine-formol, glyoxal, cross-linked cationic amine polyalkylenes, melamine-formaldehyde and amino-caproic acid condensation products.

A fungicide and/or bactericide agent and also conventional auxiliary additives to printing and writing paper coating baths like:

a dispersing agent like sodium hexametaphosphate or pyrophosphate, caustic soda or sodium polyacrylate;

a lubricating agent like the fatty acid derivatives, for example sodium or calcium stearate;

a viscosity regulator like gelatin, carboxymethylcellulose, ammonium polyacrylate, sodium silicate, ethylenediamine or urea.

According to a preferred embodiment the process according to the invention comprises the following stages.

1st Stage (1) The fibres in aqueous suspension either from grinding in a pulper (unintegrated mill), or directly from the pulp mill (integrated mill) are stored at 40–100 g/l in an agitated vat.

(2) The pulp is refined in the conventional manner to a Schoepper Riegler level of between 15 and 65 depending on the applications, at a varying concentration lying between 20 and 60 g/l, by means of standard conical or double disc refiners, or else at 250–350 g/l with special refiners for high-concentration refining, notably in the case of manufacturing packaging media in order to obtain high tear strength.

3° If necessary the anionic retention agent in aqueous solution is added with agitation.

2nd Staqe (1) Preparation of the mineral filler/organic binder suspension.

The mineral filler is dispersed in the aqueous phase in a vat at a concentration varying between 400 and 600 g/l. Depending on the type of filler, and in order to encourage dispersion homogeneity so as to prevent lumps forming, it is sometimes worth using a mineral dispersant like sodium hexametaphosphate or an organic dispersant like sodium polyacrylate in amounts lying between 0.02 and 1% of the mineral filler. If talc is used as the mineral filler this operation is not necessary since this filler can be dispersed very easily in water at 150–600 g/l with no special additive.

(2) The organic binder, which is ready to use if it is a latex, for example, or after cooking if native, oxidized or etherized dextrine starches are used, or starch esters, or after enzymization if a native starch is used, is mixed with the filler dispersed with agitation. This mixing operation with agitation may very easily be carried out continuously in a static mixer of conical or cylindrical offset propeller type or in dynamic mixers, particularly as it is possible in these types of appliance to adjust the dilution in accordance with the required concentration of the final bath, which is 50 to 200 g/l before flocculation.

If the installation is not equipped with a mixer it is recommended to homogenize the filler/binder bath at 200–500 g/l before diluting it between 100 and 350 g/l.

(3) The cationic flocculant is incorporated into the filler/binder suspension, preferably by proportioning pump, after being diluted 1 to 10 times beforehand.

3rd Staqe

The mineral filler/organic binder flocs in aqueous suspension are then introduced continuously into the pulp from the first stage before or after this pump has been cleaned.

4th Staqe

The other additives necessary to obtain the final properties of the sheet material, like optical blueing agents, wet strength agents, etc. may be added either in the refined pulp storage vat or continuously in the head circuit after incorporation of the flocculated mineral filler and organic binder.

However, the pH regulator and the sizing agent normal in papermaking are preferably incorporated into the pulp after all the other additives, which is the usual practice in paper manufacture.

If necessary, it is also possible, as is commonly done in the paper industry, particularly when the filler contents are very high, to incorporate the conventional retention agent before the head box.

The mixture thus prepared is conveyed to the head box and is subsequently subjected to the normal treatments of the paper manufacturing process such as draining, wet pressing, drying, and possibly friction glazing, surfacing on the paper machine or off it, glazing, calendering, coating, graining.

The following examples, given as illustrations and in no way limiting the scope of the present invention, will enable the advantages of the process according to the invention to be more clearly understood.

EXAMPLES 1 TO 4

Several kraft packaging media are prepared by processes from previous practice (Examples 1 and 2) and by the process according to the invention (Examples 3 and 4). The residual ash content of the control medium is set at about 10%.

EXAMPLE 1

A control kraft packaging medium is prepared using neither binder nor flocculant, with the following constituents:

| | Parts by weight |
|---|---|
| Unbleached softwood kraft* with an SR refining level of 25 | 100 |
| Talc | 30 |
| Modified collophane emulsion | 1 |
| Ammonium sulphate in solution to make up to pH 4.5 | |

*Softwood pulp treated with caustic soda and unbleached.

EXAMPLE 2

The control kraft packaging medium is prepared using a binder and a flocculant which is added after the binder in the fibre suspension by means of the following constitutents:

| | Parts by weight |
|---|---|
| Unbleached softwood kraft having an SR refining level of 25 | 100 |
| Talc | 30 |
| Cooked native starch | 3 |
| Polyaluminium chloride flocculant | 0.3 |
| Modified collophane emulsion | 1 |
| Aluminium sulphate in solution to make up to pH 4.5 | |

EXAMPLE 3

A kraft packaging medium is prepared using the process according to the invention.

First of all a first softwood pulp mixture is prepared having an SR refining level of 25 and an anionic retention agent.

This first mixture has the following composition.

| | Parts by weight |
|---|---|
| Unbleached softwood kraft | 100 |
| Type PA modified polyacrylamide anionic retention agent of ZSCHIMMER & SCHWARZ | 0.1 |

Then a second binder/mineral filler mixture is prepared by means of the following constituents:

| | Parts by weight |
|---|---|
| Talc to be dispersed to 400 g/l | 29 |
| Cooked native starch | 3 |

The binder is mixed with the talc, dispersed and then to the mixture is added 0.2 parts by weight of polyethylenimine in solution as the flocculant.

The second mixture is incorporated into the first mixture.

Then the following are added:

| | Parts by weight |
|---|---|
| Modified collophane emulsion | 1 |
| Ammonium sulphate in solution to make up to pH 4.5 | |

EXAMPLE 4

A kraft packaging medium is prepared according to the process of the invention in the same way as in example 3, but leaving out the anionic retention agent.

The properties of the kraft packaging media obtained in Examples 1 to 4 are collected in table 1 below.

TABLE 1

| Example numbers | Previous practice without binder or flocculant | Previous pract. without binder or flocculant | Example 3 Process according with anionic retention agent | Example 4 Process according without anionic retention agent |
|---|---|---|---|---|
| Basis weight g/m2 | 72 | 71 | 72 | 72 |
| Mean breaking length according to standard NF 03004 - in meters | 5 310 | 5 600 | 5 830 | 5 950 |
| Mean elongation on breaking % | 3.8 | 3.6 | 3.5 | 3.6 |
| Mean burst factor according to standard NF 03053 | 3.7 | 4.2 | 4.9 | 5 |
| Mean tearing resistance according to standard NF 03011 | 1 110 | 1 050 | 1 090 | 1 080 |
| Water sizing - Cobb g/m2 | 24 | 21 | 22 | 21.8 |
| Residual mineral ashes in % | 10.4 | 12.5 | 15.2 | 13 |
| Overall retention in % | 46 | 45 | 67 | 59 |

The results indicated in table 1 show that preflocculation according to the invention of the filler and of the binder before they are incorporated into the fiber suspension very much enhances the percentage of overall retention of the mineral fillers in the medium, and also certain physical properties of the medium, notably the mean breaking length, the mean burst factor and the residual mineral ash content.

It can also be seen that retention is all the better when the pulp contains an anionic retention agent.

Furthermore, the internal cohesion of the sheet material prepared according to the invention is greater by about 10% than that obtained by processes following the previous practice.

EXAMPLES 5 TO 8

A printing and writing medium sized in a neutral phase is prepared according to a process from previous practice and according to the process of the invention having a range of basis weights.

EXAMPLE 5

A printing and writing control medium is prepared having a basis weight of 100 g/m2, sized in neutral phase, using a process of previous practice in which the flocculant is added to the fibre suspension containing the mineral filler and the organic binder.

A mixture with the following composition is obtained:

| | Parts by weight |
|---|---|
| Bleached softwood kraft* | 45 |
| Bleached birchwood kraft** (pulp with an SR refining level of 30) | 55 |
| Natural calcium carbonate | 50 |

-continued

| | Parts by weight |
|---|---|
| Cooked native starch | 5 |
| Polyaluminium chloride flocculant in solution | 0.3 |
| Alkylketenedimer type Aquapel (expressed as dry weight) | 0.1 |
| Polyethylenimine in solution | 0.15 |

*softwood pulp treated with caustic soda and bleached.
**birchwood pulp treated with caustic soda and bleached.

EXAMPLE 6

A printing and writing medium of the previous type is prepared, but having a basis weight of 200 g/m2.

EXAMPLE 7

A printing and writing medium is prepared sized in neutral phase, having a basis weight of 100 g/m2, according to the process of the invention.

First of all a first mixture is prepared with the following composition:

| | Parts by weight |
|---|---|
| Bleached softwood kraft | 45 |
| Bleached birchwood kraft (pulp refined to 30° SR) | 55 |
| Type PA modified polyacrylamide anionic retention agent of ZSCHIMMER & SCHWARZ | 0.1 |

A second binder/mineral filler mixture is prepared having the following composition:

| | Parts by weight |
|---|---|
| Natural calcium carbonate (to be dispersed to 500 g/l) | 50 |
| Cooked native starch | 5 |

The starch binder is mixed with the dispersed carbonate filler, then 0.3 parts by weight of polyethylenimine in solution is added to flocculate the mixture.

The second mixture is incorporated into the first mixture, then the following is introduced:

| | Parts by weight |
|---|---|
| Alkylketenedimer type Aquapel | 0.1 |
| Polyethylenimine in solution | 0.15 |

EXAMPLE 8

A printing and writing medium is prepared in the same way as in example 7, this medium having a basis weight of 200 g/m2.

The properties of the printing and writing media obtained in examples 5 to 8 are collected in table 2 below.

TABLE 2

| | Example numbers | | | |
|---|---|---|---|---|
| | Example 5 Control - previous practice 100 g/m2 | Example 6 Control - previous practice 200 g/m2 | Example 7 Process of invention 100 g/m2 | Example 8 Process of invention 200 g/m2 |
| Basis weight g/m2 | 99 | 201 | 100 | 198 |
| Mean breaking length in meters (stand. NF 03004) | 4 900 | 5 300 | 5 200 | 5 100 |
| Mean burst factor (stand. NF 03053) | 2.9 | 2.7 | 2.8 | 2.6 |
| Residual mineral ash in % | 19.8 | 20.2 | 26 | 28 |
| Overall retention in % | 59 | 61 | 78 | 82 |

The results indicated in the above table show that the process according to the invention makes it possible to enhance the overall retention percentage of the mineral fillers in the medium and the strength of this latter since, with a higher ash content, the physical properties of the media according to the invention are roughly equivalent to the properties of the control specimens.

EXAMPLE 9

This example illustrates the reuse of a bath commonly used in coating in the process according to the invention.

A first mixture is prepared with the following composition:

| | Parts by weight |
|---|---|
| Bleached bisulphite hardwood* | 40 |
| Bleached bisulphite hardwood** | 30 |
| Waste paper stock (pulp with an SR refining level of 35) | 30 |
| Type PA modified polyacrylamide anionic retention agent of ZSCHIMMER & SCHWARZ | 0.1 |

*Softwood pulp treated with bisulphite and bleached.
**Hardwood pulp treated with bisulphite and bleached The second mixture is made up of a coating bath used for printing and writing media usable for offset printing. This coating bath has the following composition:

| | Parts by weight |
|---|---|
| Kaolin | 100 |
| Sodium polyacrylate dispersant | 0.3 |
| Oxidized starch | 15 |
| Styrene-butadiene latex | 10 |

The bath is diluted beforehand to 150 g/l then, with agitation, the cationic flocculant, previously diluted five times, is added in; this flocculant consists of 0.15 parts by weight of polyethylenimine in solution for 100 parts by weight of fillers and binder.

The second flocculated mixture is incorporated into the first mixture, then the following is introduced:

| | Parts by weight |
|---|---|
| Modified collophane emulsion | 1 |
| Ammonium sulphate in solution to make up to pH 4.5 | |
| Cationic modified polyacrylamide retention agent | 0.15 |

The sheet formed is characterized by a residual filler content of 26%, which indicates good retention on the screen, and by high internal cohesion.

I claim:

1. A process using paper-making techniques for producing a fibrous sheet comprising fibers, an organic binder, a non-binding mineral filler and a flocculant, designed to improve the retention of the mineral filler in the sheet, sheet formation and the sheet's physical properties, which comprises the following steps in the following order:

dispersing a non-binding mineral filler in an aqueous medium at a concentration from 150 to 600 g/l, mixing an anionic organic binder selected from the group consisting of native starches, chemically, enzymatically or thermally modified starches, dextrines, casein, animal glue, vegetable proteins, cellulose esters, alginates carboxylated or uncarboxylated styrene-butadiene latexes, acrylic latexes, styrene acrylics, vinyl acetates, neoprene latexes, acrylonitrile latexes and vinyl chloride latexes with the dispersed filler under agitation, continuously in a mixer in order to obtain an aqueous dispersion of mineral filler particles coated with binder which, after dilution, has a concentration from 50 to 200 g/l before flocculation;

carrying out continuously ionic destabilization of said aqueous dispersion of mineral filler particles coated with binder by means of a cationic flocculant selected from the group consisting of aqueous solutions of polyethylenimine, polyamido-amine, cross-linked polyalkylamine, modified polyacrylamides, polyaluminium chloride and quaternary ammonium compounds in order to obtain improved flocculation control and good uniformity of the floc particle size, which favors formation, appearance, uniformity of surface and dimensional stability of the sheet;

then continuously introducing the mineral filler/organic binder flocs in aqueous suspension into the refined pulp storage vat, conveying the mixture thus prepared to the head box and subsequently subjecting it to the draining, wet pressing and drying usual treatments of the paper manufacturing process for obtaining the fibrous sheet wherein the amount of binder lies between 1 and 40 parts by weight per 100 parts by weight of fibers and filler.

2. The process of claim 1, wherein the non-binding mineral filler is selected from the group consisting of talc, kaolin, natural or precipitated calcium carbonate, or calcium carbonate from recovery operations on the black liquor extracted from digestion of draft pulps, alumina hydrates and titanium dioxide.

3. The process of claim 1, wherein the amount of binder used lies between 1 and 25 parts by weight per 100 parts by weight of fibers and filler.

4. The process of claim 1, wherein the flocculating agent is incorporated in an amount of between 0.006 and 5 parts by weight per 100 parts by weight of mineral filler and binder.

5. The process of claim 1, wherein the flocculating agent is incorporated in an amount of between 0.01 and 2 parts by weight per 100 parts by weight of mineral filler and binder.

6. The process of claim 1 wherein at least one conventional paper industry additive selected from the group consisting of an anti-foam agent, an optical blueing agent, a dyeing or shading agent, a wet strength agent, a fungicide and/or bactericide, a dispersing agent, a lubricating agent, and a viscosity regulator is added in the refined pulp storage vat or continuously in the head circuit after incorporation of the flocculated mineral filler and organic binder.

7. The process of claim 1 where in a pH regulator and a sizing agent are incorporated into the pulp.

8. The process of claim 1 wherein the ionic destabilization of the homogeneous filler-binder bath is obtained by incorporating continuously into said bath a cationic flocculant previously diluted one to ten times.

9. The process of claim 1 wherein, before incorporation of the mineral filler/organic binder flocs into the pulp, the anionic strength of the latter is increased by adding, with agitation, an anionic type retention agent.

10. The process of claim 9, wherein the retention agent of anionic type is selected from high molecular weight modified polyacrylamides and sodium polyacrylates.

11. The process of claim 1 wherein the aqueous dispersion of mineral filler particles coated with binder is a stable coating bath containing a mineral or organic dispersant in an amount from 0.02 to 1% by weight of the mineral filler.

* * * * *

UNITED STATES PATENT AND TRADEMARK OFFICE

CERTIFICATE OF CORRECTION

PATENT NO. : 4,943,349

DATED : July 24, 1990

INVENTOR(S) : Daniel Gomez

It is certified that error appears in the above-identified patent and that said Letters Patent is hereby corrected as shown below:

Claim 2, column 10, line 64: "draft" should read --- kraft ---

Signed and Sealed this

Twenty-eighth Day of January, 1992

*Attest:*

HARRY F. MANBECK, JR.

*Attesting Officer*

*Commissioner of Patents and Trademarks*